US011541520B2

(12) United States Patent
Lin

(10) Patent No.: US 11,541,520 B2
(45) Date of Patent: Jan. 3, 2023

(54) TORQUE OUTPUT DEVICE FOR RATCHET WRENCH

(71) Applicant: AIDOX TECHNOLOGY CORPORATION, Taichung (TW)

(72) Inventor: Chien-Fu Lin, Taichung (TW)

(73) Assignee: AIDOX TECHNOLOGY CORPORATION, Taichung (TW)

( * ) Notice: Subject to any disclaimer, the term of this patent is extended or adjusted under 35 U.S.C. 154(b) by 232 days.

(21) Appl. No.: 16/951,355

(22) Filed: Nov. 18, 2020

(65) Prior Publication Data

US 2022/0080567 A1 Mar. 17, 2022

(30) Foreign Application Priority Data

Sep. 17, 2020 (TW) ..... 109132072

(51) Int. Cl.
*B25B 23/157* (2006.01)
*B25B 23/142* (2006.01)
*B25B 23/00* (2006.01)

(52) U.S. Cl.
CPC ..... *B25B 23/1427* (2013.01); *B25B 23/0007* (2013.01)

(58) Field of Classification Search
CPC ..... B25B 23/1427; B25B 23/0007
USPC ..... 81/475, 467, 473
See application file for complete search history.

(56) References Cited

U.S. PATENT DOCUMENTS 7,197,968 B2 * 4/2007 Bubel ..... B25B 15/02 192/56.62
7,765,900 B2 * 8/2010 Wu ..... B25B 23/1427 81/475
10,279,146 B2 * 5/2019 Ivinson ..... B25B 23/141

* cited by examiner

*Primary Examiner* — Joseph J Hail
*Assistant Examiner* — Shantese L Mcdonald
(74) *Attorney, Agent, or Firm* — Muncy Geissler Olds & Lowe P.C.

(57) ABSTRACT

A torque output device includes a body with an opening in the top. A top toothed part is located beneath the opening and includes a bore located corresponding to the opening. The top toothed part includes multiple top teeth. A drive shaft secured in the body and includes a central hole in which a rod is located. A driving portion is formed to the lower end of the drive shaft. The drive shaft and the top toothed part are freely rotated relative to each other. A bottom toothed part is mounted to the drive shaft and freely moves up and down relative to the drive shaft. A resilient member is mounted to the drive shaft and biases the bottom toothed part. A pressure collar is threadedly connected to the lower end of the body to set the torque between the engagement of the top and bottom teeth.

20 Claims, 9 Drawing Sheets

TORQUE OUTPUT DEVICE FOR RATCHET WRENCH

BACKGROUND OF THE INVENTION a) Field of the Invention

The present invention relates to a torque output device for a ratchet wrench, and more particularly, to a torque output device that precisely sets the output torque.

b) Description of the Prior Art

The conventional way to fasten objects is to use a wrench to tighten a bolt or the like. In order to properly apply a specific torque to the bolt, the users have to carefully to feel the tightness when rotating the bolt. However, this conventional way is not a precise method to apply the desired torque to the bolt, and the bolt may be overly rotated and broken, or the object is damaged due to the improper torque applied. A torque wrench is used where to set the desired torque to be applied to the bolt so that it can be matched to the specifications for a particular application.

The known torque wrenches includes a compression spring, and when the set output is reached, there is a mechanism to be disengaged from the spring so as to create a sound. The users then are acknowledged that the desired torque is applied to the bolt. Nevertheless, there always a time lap when the users hear the sound and stop operating the torque wrench. In other words, the bolt will be rotated by an exceeded torque because of the time lap. Besides, the conventional torque wrenches cannot be cooperated with pneumatic or electric tools.

The present invention intends to provide a torque output device that eliminates shortcomings mentioned above.

SUMMARY OF THE INVENTION

The present invention relates to a torque output device and comprises a body having a U-shaped cross section. An opening is formed centrally in the top thereof. A washer is connected to the lower end of the body. A top toothed part is fixed to the body and located beneath the opening. The top toothed part includes a bore defined centrally therein. The top toothed part includes multiple top teeth extending from the underside thereof. The bore is located corresponding to the opening. Each top tooth of the top toothed part includes an angle between two tooth surfaces thereof, and the angle is 10 to 90 degrees. Each top tooth of the top toothed part includes a rounded corner at the left corner of the top land thereof. A drive shaft includes a central hole defined centrally in the top thereof. A rod is located in the central hole. Multiple first grooves are formed axially along the outer surface of the upper section of the drive shaft. A driving portion is formed to the lower end of the drive shaft. A bolt extends through bore of the top toothed part and is connected to the central hole of the drive shaft. The bolt contacts the rod in the central hole so that the drive shaft and the top toothed part are freely rotated relative to each other. A bottom toothed part is mounted to the drive shaft and includes multiple bottom teeth which are engaged with the top teeth of the top toothed part. Each bottom tooth of the bottom toothed part includes a rounded corner at the right corner of the top land thereof. Multiple second grooves are formed axially along the inner surface of the bottom toothed part and located corresponding to the first grooves of the drive shaft. A stop plate is connected to the lower end of the second grooves. Multiple rollers are rotatably located between the first and second grooves so that the bottom toothed part is movable axially relative to the drive shaft. A resilient member is mounted to the drive shaft. The resilient member is biased between the bottom toothed part and the washer. A pressure collar is threadedly connected to the lower end of the body.

Preferably, a top driving portion is formed to the top of the body.

Preferably, the top driving portion is integrally formed with the body.

Preferably, multiple balls are located between the washer and the pressure collar.

Preferably, the body includes a grip formed to an outside thereof.

Preferably, a first seal is located between a top of the top toothed part and the opening of the body. A second seal is located between the pressure collar and the drive shaft. A third seal is located between the pressure collar and the body. The body includes lubricant received therein.

Preferably, each top tooth of the top toothed part includes a rounded corner at the right corner of the top land thereof. Each bottom tooth of the bottom toothed part includes a rounded corner at the left corner of the top land thereof.

Preferably, a cushion plate is located at the top of the second grooves of the bottom toothed part.

Another embodiment of the torque output device of the present invention comprises a body having a U-shaped cross section. An engaging hole is formed in the top thereof so as to be connected with a wrench. A washer is connected to a lower end of the body. Atop toothed part is fixed to the body and located beneath the engaging hole. The top toothed part includes a bore defined centrally therein. Multiple top teeth extend from the underside of the top toothed part. The bore is located corresponding to the engaging hole. Each top tooth of the top toothed part has an angle between two tooth surfaces thereof. The angle is 10 to 90 degrees. Each top tooth of the top toothed part includes a rounded corner at the left corner of the top land thereof. A drive shaft includes a central hole defined centrally in the top thereof. A rod is located in the central hole. Multiple first grooves are formed axially along the outer surface of the upper section of the drive shaft. A driving portion is formed to the lower end of the drive shaft. A bolt extends through bore of the top toothed part and is connected to the central hole of the drive shaft. The bolt contacts the rod in the central hole so that the drive shaft and the top toothed part are freely rotated relative to each other. A bottom toothed part is mounted to the drive shaft and includes multiple bottom teeth which are engaged with the top teeth of the top toothed part. Each bottom tooth of the bottom toothed part includes a rounded corner at the right corner of the top land thereof. Multiple second grooves are formed axially along the inner surface of the bottom toothed part and located corresponding to the first grooves of the drive shaft. A stop plate is connected to the lower end of the second grooves. Multiple rollers are rotatably located between the first and second grooves so that the bottom toothed part is movable axially relative to the drive shaft. A resilient member is mounted to the drive shaft, and the resilient member is biased between the bottom toothed part and the washer. A pressure collar is threadedly connected to the lower end of the body.

Preferably, multiple balls are located between the washer and the pressure collar.

Preferably, a first seal is located between the top of the top toothed part and the engaging hole of the body. A second seal is located between the pressure collar and the drive shaft. A third seal is located between the pressure collar and the body. The body includes lubricant received therein.

Preferably, each top tooth of the top toothed part includes a rounded corner at the right corner of the top land thereof. Each bottom tooth of the bottom toothed part includes a rounded corner at the left corner of the top land thereof.

Preferably, a cushion plate is located at a top of the second grooves of the bottom toothed part.

The present invention also provides yet another embodiment of the torque output device which comprises a body having a U-shaped cross section and an engaging hole is formed centrally in the top thereof. Multiple threads are formed on the outer surface of the lower end of the body. A mark ring is mounted to the upper portion of the body and secured by a fastening member. A top toothed part is fixed to the body and located beneath the engaging hole. The top toothed part includes a bore defined centrally therein. Multiple top teeth extend from the underside of the top toothed part. The bore is located corresponding to the engaging hole. Each top tooth of the top toothed part has an angle between two tooth surfaces thereof. The angle is 10 to 90 degrees. Each top tooth of the top toothed part includes a rounded corner at the left corner of the top land thereof. A drive shaft includes a central hole defined centrally in the top thereof. A rod is located in the central hole. Multiple first grooves are formed axially along the outer surface of the upper section of the drive shaft. A driving portion is formed to the lower end of the drive shaft. A clip is mounted to the outside of the driving portion. A bolt extends through the bore of the top toothed part and is connected to the central hole of the drive shaft. The bolt contacts the rod in the central hole so that the drive shaft and the top toothed part are freely rotated relative to each other. A bottom toothed part is mounted to the drive shaft and includes multiple bottom teeth which are engaged with the top teeth of the top toothed part. Each bottom tooth of the bottom toothed part includes a rounded corner at the right corner of the top land thereof. Multiple second grooves are formed axially along the inner surface of the bottom toothed part and located corresponding to the first grooves of the drive shaft. A stop plate is connected to the lower end of the second grooves. Multiple rollers are rotatably located between the first and second grooves so that the bottom toothed part is movable axially relative to the drive shaft. A first resilient member is mounted to the drive shaft. The top end of the first resilient member contacts the bottom toothed part. A pressure collar is mounted to the drive shaft and contacting the lower end of the first resilient member. A torque adjustment member has multiple threads formed in the inner periphery thereof. The torque adjustment member is threadedly connected to the body from the lower end of the body. The inner end of the lower end of the torque adjustment member contacts the underside of the pressure collar. The torque adjustment member includes a radial hole defined through the wall thereof. When the torque adjustment member is rotated relative to the body, the first resilient member is compressed by the pressure collar. A securing unit is connected to the radial hole of the torque adjustment member so as to secure the torque adjustment member to the body.

Preferably, the first resilient member is located within a second resilient member, wherein the second resilient member is biased between the bottom toothed part and the pressure collar.

Preferably, a first seal is located between the top toothed part and the engaging hole of the body. A second seal is located between the pressure collar and the drive shaft. A third seal is located between the pressure collar and the body. The body includes lubricant received therein.

Preferably, the securing unit includes a tube which is welded to the radial hole of the torque adjustment member. A copper sleeve is located in the tube and has multiple threads which are threadedly connected to the threads of the body. A screw is threadedly connected to the tube and contacts the copper sleeve so as to secure the torque adjustment member to the body.

Preferably, a washer is located on the inner end of the lower end of the torque adjustment member. A room is formed between the pressure collar and the washer. The multiple balls are located in the room between the pressure collar and the washer.

Preferably, each top tooth of the top toothed part includes a rounded corner at the right corner of the top land thereof. Each bottom tooth of the bottom toothed part includes a rounded corner at the left corner of the top land thereof.

Preferably, a cushion plate is located at the top of the second grooves of the bottom toothed part.

The present invention provides a torque output device cooperated with a wrench and is cable to precisely output a torque. When the desired torque reaches, the bottom toothed part is disengaged from the top toothed part and moved freely relative to the drive shaft with almost zero friction.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
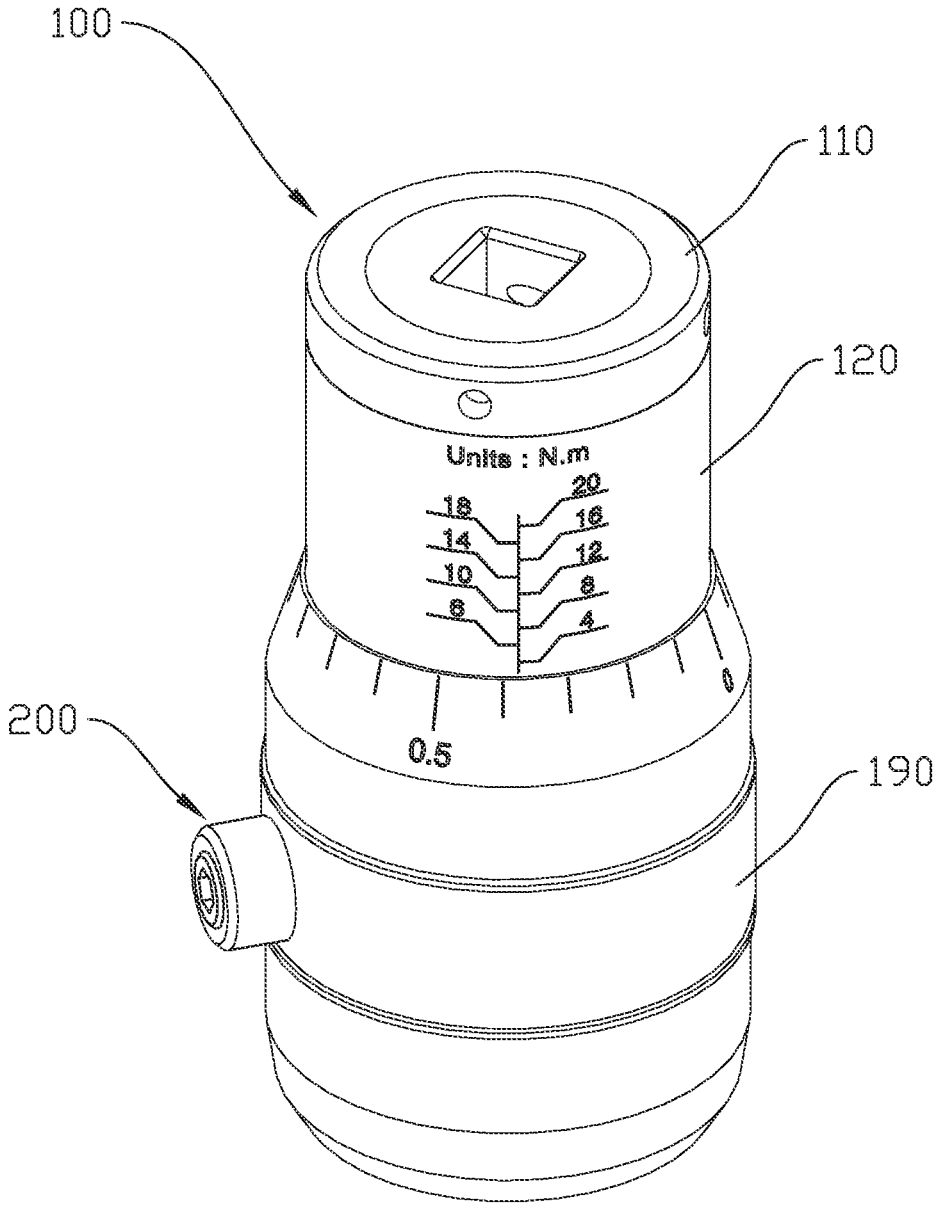
FIG. 1 is a perspective view to show the toque output device of the present invention.
Figure 2A:
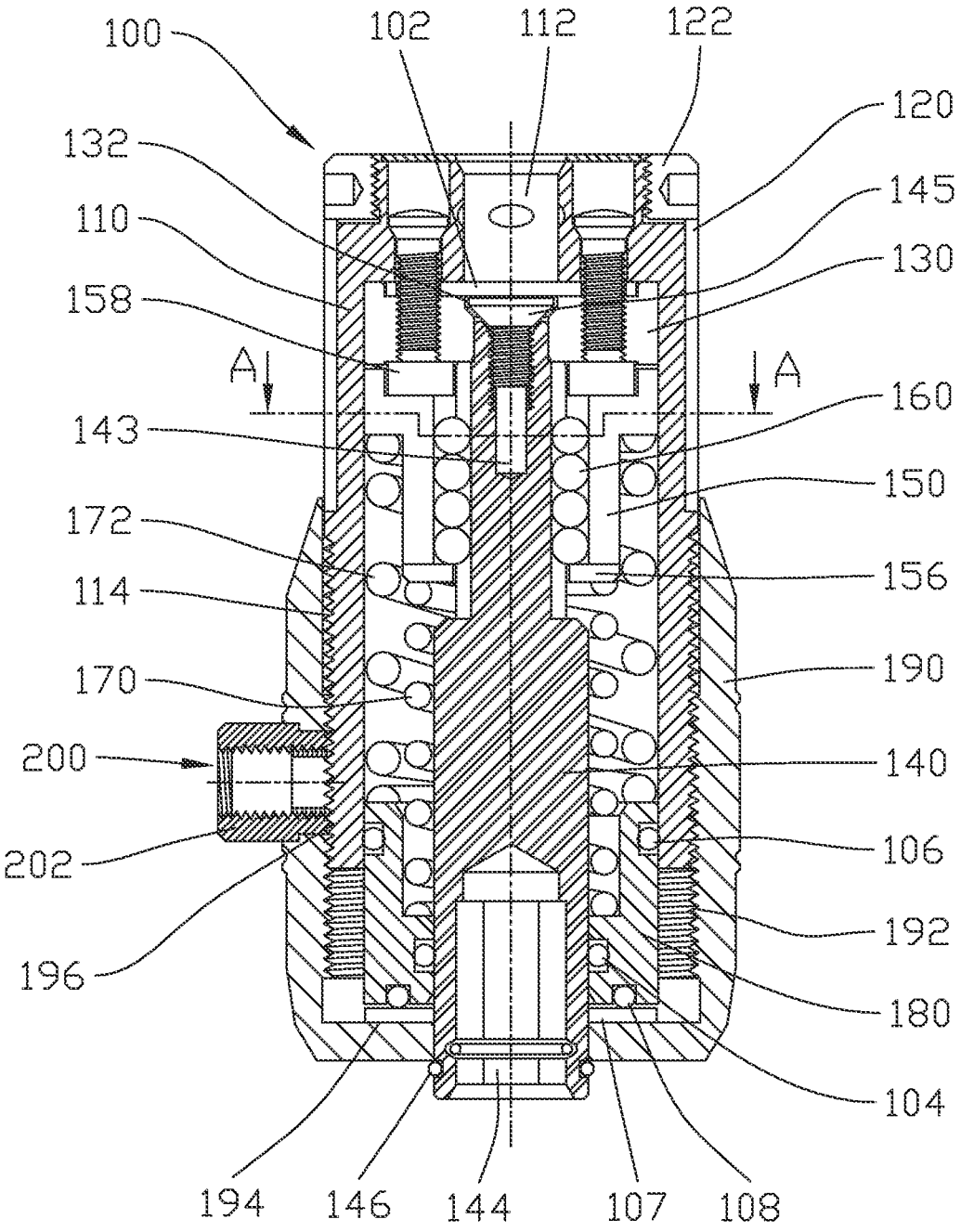
FIG. 2A is a cross sectional view of the toque output device of the present invention.

Referring to FIGS. 1 and 2A, the torque output device 100 of the present invention comprises a body 110, a mark ring 120, a top toothed part 130, a drive shaft 140, a bottom toothed part 150, multiple rollers 160, a first resilient member 170, a pressure collar 180, a torque adjustment member 190 and a securing unit 200.

The body 110 has a U-shaped cross section and an engaging hole 112 is formed centrally in the top thereof so as to be connected with a wrench, a pneumatic tool or an electric tool. Multiple threads 114 are formed on the outer surface of the lower end of the body 110. The mark ring 120 is mounted to the upper portion of the body 110 and secured by a fastening member 122.

Figure 3:
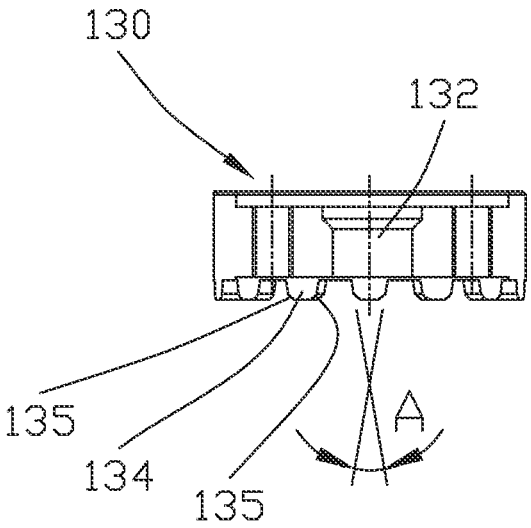
FIG. 3 shows the side view of the top toothed part of the toque output device disclosed in FIG. 2A.

As shown in FIGS. 2A and 3, the top toothed part 130 is fixed to the body 110 and located beneath the engaging hole 112. The top toothed part 130 includes a bore 132 defined centrally therein. Multiple top teeth 134 extend from the underside of the top toothed part 130. The bore 132 is located corresponding to the engaging hole 112. Each top tooth 134 of the top toothed part 130 has an angle "A" between two tooth surfaces thereof. The angle "A" is 10 to 90 degrees.

Figure 2B:
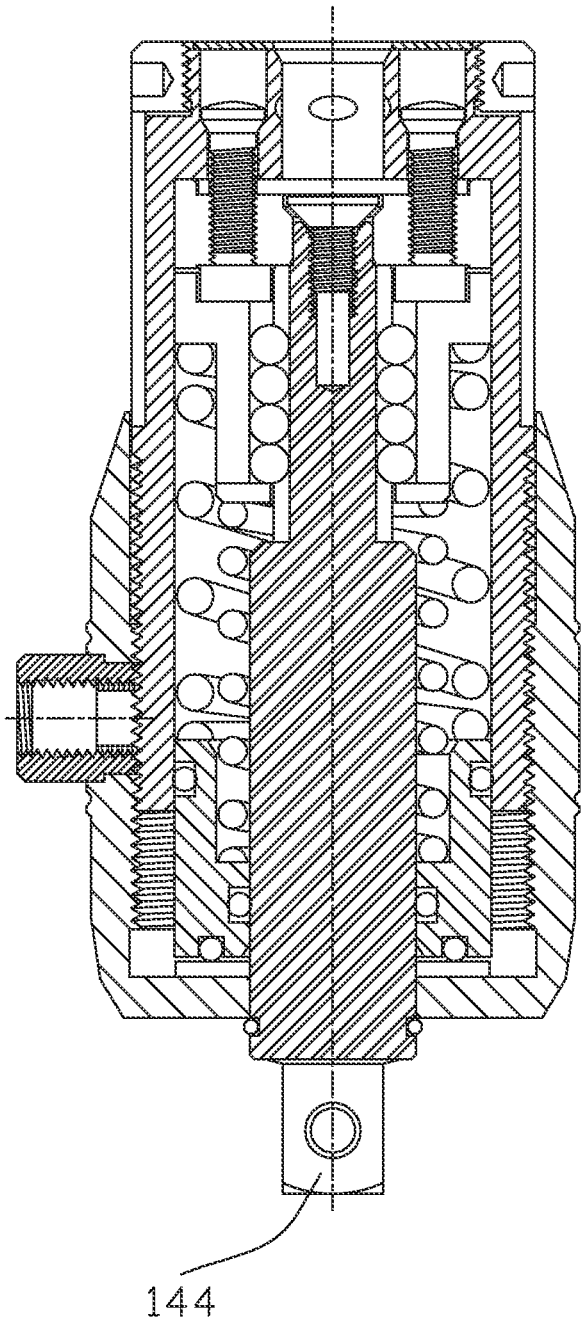
FIG. 2B is a cross sectional view to show another embodiment of the toque output device of the present invention.
Figure 4:
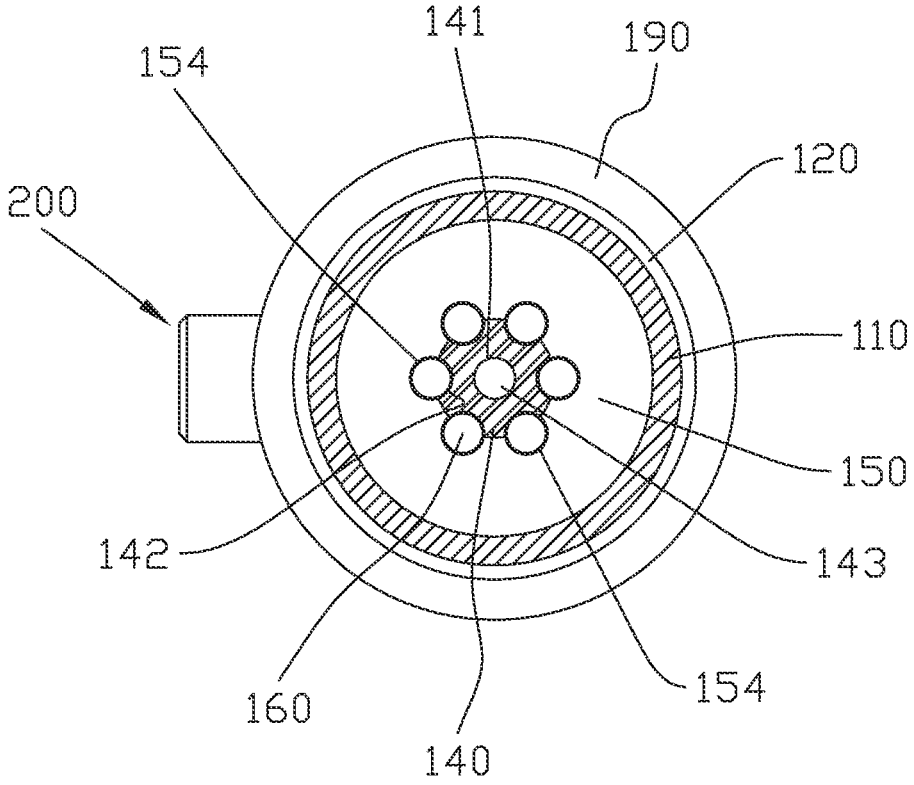
FIG. 4 is a cross sectional view, taken along line A-A in FIG. 2A.

As shown in FIGS. 2A and 4, a drive shaft 140 includes a central hole 141 defined centrally in the top thereof. A rod 143 is located in the central hole 141. Multiple first grooves 142 are formed axially along the outer surface of the upper section of the drive shaft 140. A driving portion 144 is formed to the lower end of the drive shaft 140 so as to be connected to an object (not shown). A bolt 145 extends through the bore 132 of the top toothed part 130 and is connected to the central hole 141 of the drive shaft 140. The lower end of the bolt 145 contacts the rod 143 in the central hole 141 so that the bolt 145 cannot be further lowered in the central hole 141, such that the head of the bolt 145 does not connect the top toothed part 130 to the drive shaft 140. In other words, there is a small gap formed between the head of the bolt 145 and the top toothed part 130. Therefore, the drive shaft 140 and the top toothed part 130 are freely rotated relative to each other. The driving portion 144 as shown in FIG. 2B can be a rectangular protrusion or a hexagonal recess so as to be connected to a socket or a screwdriver bit. A clip 146 is mounted to the outside of the driving portion 144 so as to prevent the torque adjustment member 190 from dropping.

Figure 5:
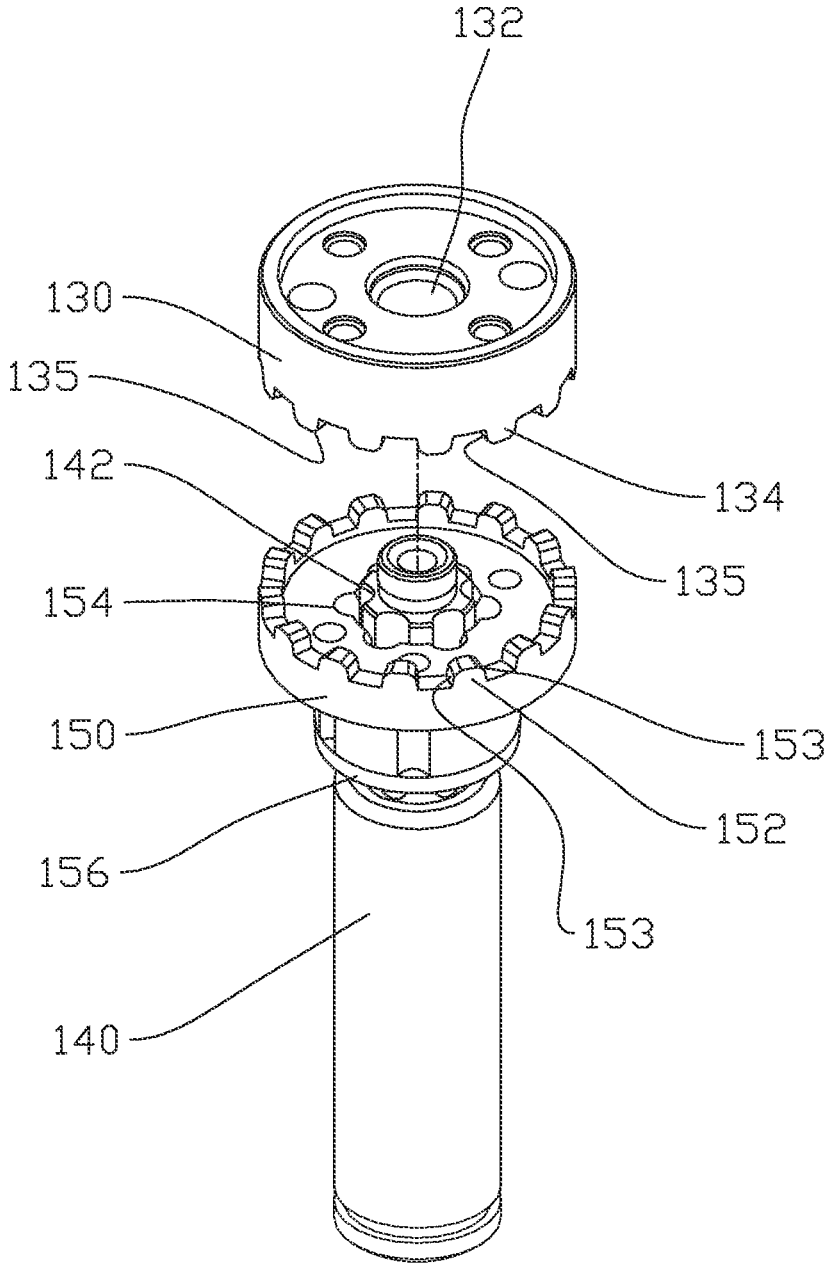
FIG. 5 shows that the top toothed part, the bottom toothed part and the drive shaft of the toque output device disclosed in FIG. 2A.

As shown in FIG. 5, the bottom toothed part 150 is mounted to the drive shaft 140 and includes multiple bottom teeth 152 which are engaged with the top teeth 134 of the top toothed part 130. Each top tooth 134 of the top toothed part 130 includes a rounded corner 135 at the left corner of the top land thereof. Each bottom tooth 152 of the bottom toothed part 150 includes a rounded corner 153 at the right corner of the top land thereof. Therefore, when a desired torque reaches, the bottom toothed part 150 can be successfully disengaged from the top toothed part 130. It is noted that the rounded corners 135, 153 can also be formed in each corner of the top land of each of the top tooth 134 and each bottom tooth 152.

Multiple second grooves 154 are formed axially along the inner surface of the bottom toothed part 150 and located corresponding to the first grooves 142 of the drive shaft 140. Multiple rollers 160 are rotatably located between the first and second grooves 142, 154 so that the bottom toothed part 150 is movable axially relative to the drive shaft 140. That is to say, the bottom toothed part 150 is movable axially relative to the drive shaft 140 with almost zero friction. A stop plate 156 is connected to the lower end of the second grooves 154 to restrict the rollers 156 from dropping. A cushion plate 158 is located at the top of the second grooves 154 of the bottom toothed part 150 so as to reduce vibration or impact when the bottom toothed part 150 is separated from the top toothed part 130.

The first resilient member 170 is mounted to the drive shaft 14. The top end of the first resilient member 170 contacts the bottom toothed part 150. A pressure collar 180 is mounted to the drive shaft 140 and contacting the lower end of the first resilient member 170. In another embodiment, the torque adjustment device 100 includes a second resilient member 172. The first resilient member 170 is located within the second resilient member 172, and the second resilient member 172 is biased between the bottom toothed part 150 and the pressure collar 180.

The torque adjustment member 190 has multiple threads 192 formed in the inner periphery thereof. The torque adjustment member 190 is threadedly connected to the body 110 from the lower end of the body 110. The inner end of the lower end of the torque adjustment member 190 contacts the underside of the pressure collar 180. When the torque adjustment member 190 is rotated relative to the body 110, the first and second resilient members 170, 172 are compressed by the pressure collar 180. The torque adjustment member 190 includes a radial hole 196 defined through the wall thereof. A securing unit 200 is connected to the radial hole 196 of the torque adjustment member 190 so as to secure the torque adjustment member 190 to the body 110.

Specifically, when the torque adjustment member 190 is rotated relative to the body 110, the first and second resilient members 170, 172 are compressed by the pressure collar 180 so as to provide a force (frictional force) to engage the bottom toothed part 130 with the top toothed part 150. When the users use the present invention to apply a torque to an object that is connected to the driving portion 144, the frictional force between the top and bottom toothed parts 130, 150 rotates both of the top and bottom toothed parts 130, 150. The drive shaft 140 is rotated by the bottom toothed part 150 because the rollers 160 are located in the first and second grooves 142, 154. The shaft 140 is therefore rotated to transfer a torque to the object engaged with the driving portion 144. When the users apply the torque that is larger than the frictional force between the top and bottom toothed parts 130, 150, the top and bottom toothed parts 130, 150 are separated from each other. The bottom toothed part 150 moves up and down relative to the drive shaft 140 because of the rollers 160 in the first and second grooves 142, 154, and cannot drive the drive shaft 140 to rotate. Thanks to the rollers 160 located between the first and second grooves 142, 154, the bottom toothed part 150 moves with almost zero frictional force relative to the drive shaft 140. Accordingly, the torque that separates the top toothed part 130 from the bottom toothed part 150 is the desired torque that is equal to the frictional force between the top and bottom toothed parts 130, 150. The force required to achieve the desired torque equals to the force that the first and second resilient members 170, 172 applied to the bottom toothed part 150.

Assume the frictional force between the first and second resilient members 170, 172 is fixed, then the larger the angle "A" of each top tooth 134 of the top toothed part 130, the smaller the frictional force between the top and bottom toothed parts 130, 150. In other words, a smaller output torque can be reached. On the contrary, the smaller the angle "A" of each top tooth 134 of the top toothed part 130, the larger the frictional force between the top and bottom toothed parts 130, 150. In other words, the larger output torque can be reached. However, if the angle "A" is too large, the frictional force between the top and bottom toothed parts 130, 150 will be too small, or if the angle "A" is too small, the frictional force between the top and bottom toothed parts 130, 150 will be too large, both situations do not meet practical needs. Preferably, the angle "A" is 10 to 90 degrees.

Preferably, a first seal 102 is located between the top toothed part 130 and the engaging hole 112 of the body 110. A second seal 104 is located between the pressure collar 180 and the drive shaft 140. A third seal 106 is located between the pressure collar 180 and the body 110. The body 110 includes lubricant received therein. As shown in FIG. 2A, the lubricant provides features of lubrication and heat dissipation.

A washer 107 is located on the inner end of the lower end of the torque adjustment member 190. A room is formed between the pressure collar 180 and the washer 107. The multiple balls 108 are located in the room between the pressure collar 180 and the washer 107. As shown in FIG. 2A, the balls 108 reduce friction between the pressure collar 180 and the torque adjustment member 190.

Figure 6:
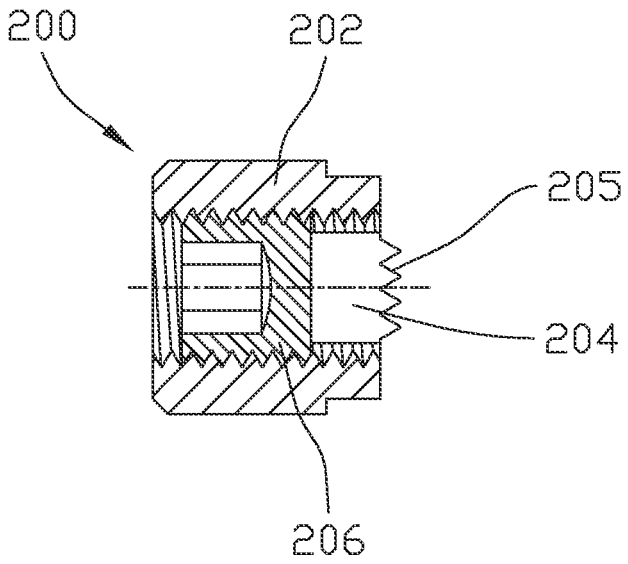
FIG. 6 is a cross sectional view to show the securing unit of the toque output device disclosed in FIG. 2A.

As shown in FIG. 6, the securing unit 200 includes a tube 202 which is welded to the radial hole 196 of the torque adjustment member 190. A copper sleeve 204 is located in the tube 202 and has multiple threads 205 which are threadedly connected to the threads 114 of the body 110. A screw 206 is threadedly connected to the tube 202 and contacts the copper sleeve 204 so as to secure the torque adjustment member 190 to the body 110.

When the users rotate the torque adjustment member 190 to push the pressure collar 180 to compress the first and second resilient members 170, 172 to set the desired output torque, the top edge of the torque adjustment member 190 is adjusted to be aligned with the marks or digits on the mark ring 120. When the desired torque value is set, the screw 206 in the tube 202 is then tightened to engage the copper sleeve 204 with the threads 114 of the body 110 to position the torque adjustment member 190 relative to the body 110 to complete the desired torque setting.

Figure 7:
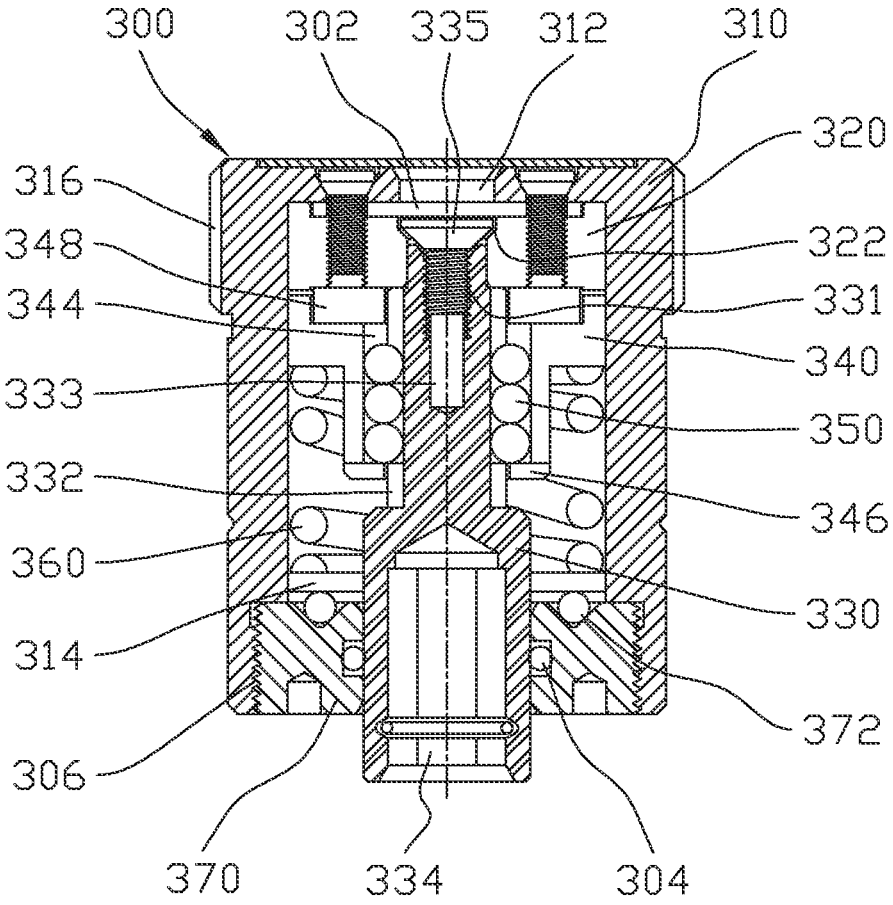
FIG. 7 is a cross sectional view to show a second embodiment of the toque output device of the present invention.

As shown in FIG. 7, a second embodiment of the torque output device 300 is disclosed and comprises a body 310, a top toothed part 320, a drive shaft 330, a bottom toothed part 340, multiple rollers 350 and a pressure collar 370.

The body 310 has a U-shaped cross section. An opening 312 is formed centrally in the top thereof. A washer 314 is connected to the lower end of the body 310. The top toothed part 320 is fixed to the body 310 and located beneath the opening 312. The top toothed part 320 includes a bore 322 defined centrally therein. The top toothed part 320 includes multiple top teeth extending from the underside thereof. The bore 322 is located corresponding to the opening 312. Each top tooth of the top toothed part 320 includes an angle "A" between two tooth surfaces thereof, and the angle "A" is 10 to 90 degrees.

The drive shaft 330 includes a central hole 331 defined centrally in the top thereof. A rod 333 is located in the central hole 331. Multiple first grooves 332 are formed axially along the outer surface of the upper section of the drive shaft 330. A driving portion 334 is formed to the lower end of the drive shaft 330. A bolt 335 extends through bore 322 of the top toothed part 320 and is connected to the central hole 331 of the drive shaft 330. The bolt 335 contacts the rod 333 in the central hole 331 so that the drive shaft 330 and the top toothed part 320 are freely rotated relative to each other.

The bottom toothed part 340 is mounted to the drive shaft 330 and includes multiple bottom teeth which are engaged with the top teeth of the top toothed part 320. Each bottom tooth of the bottom toothed part 340 includes a rounded corner at the right corner of the top land thereof so that when the desired torque is reached, the bottom toothed part 340 is disengaged from the top toothed part 320. Alternatively, each bottom tooth of the bottom toothed part 340 includes a rounded corner at both corners of the top land thereof. Multiple second grooves 344 are formed axially along the inner surface of the bottom toothed part 340 and located corresponding to the first grooves 332 of the drive shaft 330. A stop plate 346 is connected to the lower end of the second grooves 344. A cushion plate 348 is located at the top of the second grooves 344 of the bottom toothed part 340. Multiple rollers 350 are rotatably located between the first and second grooves 332, 344 so that the bottom toothed part 340 is movable axially relative to the drive shaft 330.

The resilient member 360 is mounted to the drive shaft 330. The resilient member 360 is biased between the bottom toothed part 340 and the washer 314. A pressure collar 370 is threadedly connected to the lower end of the body 310. Multiple balls 372 are located between the washer 314 and the pressure collar 370 so as to reduce friction between the pressure collar 370 and the washer 314.

Specifically, the pressure collar 370 contacts the washer 314 so as to compress the resilient member 360 to provide a force (frictional force) to engage the top and bottom toothed parts 320, 340. When the users use the present invention to apply a torque to an object, the frictional force between the top and bottom toothed parts 320, 340 rotates both of the top and bottom toothed parts 320, 340. The shaft 140 is therefore rotated and transfers the torque to the object connected to the driving portion 334. When the users apply the torque that is larger than the frictional force between the top and bottom toothed parts 320, 340, the top and bottom toothed parts 320, 340 are separated from each other, so that the drive shaft 330 is not driven and rotated. The bottom toothed part 340 moves up and down relative to the drive shaft 140 because of the rollers 350 in the first and second grooves 332, 344. Thanks to the rollers 350 located between the first and second grooves 332, 344, the bottom toothed part 340 moves with almost zero frictional force relative to the drive shaft 330. Accordingly, the desired torque is applied to the object by the torque output device 300 of the present invention by the cooperation of the resilient member 360, the pressure collar 370 locked to the body 310.

The body 310 includes a grip 316 formed to the outside thereof so that the users can easily grab and rotate the torque output device 300 without using a tool such as a wrench.

A first seal 302 is located between a top of the top toothed part 320 and the opening 312 of the body 310. A second seal 304 is located between the pressure collar 370 and the drive shaft 330. A third seal 306 is located between the pressure collar 370 and the body 310. The body 310 includes lubricant received therein. As shown in FIG. 7, the lubricant provides features of lubrication and heat dissipation.

Figure 8:
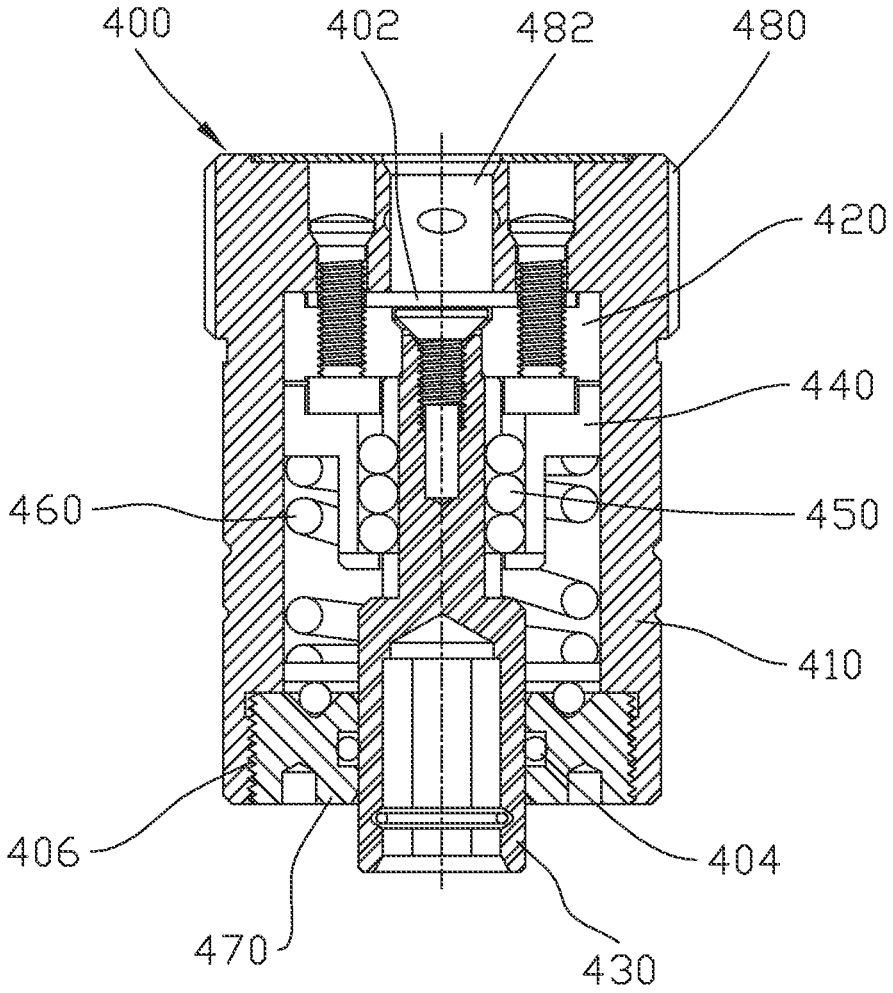
FIG. 8 is a cross sectional view to show a third embodiment of the toque output device of the present invention.

FIG. 8 shows a third embodiment of the torque output device 400 of the present invention, and the torque output device 400 of the present invention comprises a body 410, a top toothed part 420, a drive shaft 430, a bottom toothed part 440, multiple rollers 450, a resilient member 460, a pressure collar 470 and a top driving portion 480.

In this embodiment, the top toothed part 420, a drive shaft 430, a bottom toothed part 440, multiple rollers 450, a resilient member 460, a pressure collar 470 are the same as the previous embodiment, the differences are that the top driving portion 480 is formed to the top of the body 410. The top driving portion 480 includes an engaging hole 482 so as to be connected with a wrench, a pneumatic tool or an electric tool. The top driving portion 481 is integrally formed with the body 410. As shown in FIG. 8, the body 410 has a U-shaped cross section. The engaging opening 482 is formed centrally in the top of the body 410.

A first seal 402 is located between a top of the top toothed part 420 and the engaging hole 482 of the top driving portion 480. A second seal 404 is located between the pressure collar 470 and the drive shaft 430. A third seal 406 is a sealing tape and located between the pressure collar 470 and the body 410. The body 410 includes lubricant received therein, and the lubricant provides features of lubrication and heat dissipation.

While we have shown and described the embodiment in accordance with the present invention, it should be clear to those skilled in the art that further embodiments may be made without departing from the scope of the present invention.

What is claimed is:

1. A torque output device comprising:

a body having a U-shaped cross section and an opening being formed centrally in a top thereof, a washer connected to a lower end of the body;

a top toothed part fixed to the body and located beneath the opening, the top toothed part including a bore defined centrally therein, multiple top teeth extending from an underside of the top toothed part, the bore located corresponding to the opening, each top tooth of the top toothed part having an angle between two tooth surfaces thereof, the angle being 10 to 90 degrees, each top tooth of the top toothed part including a rounded corner at a left corner of a top land thereof;

a drive shaft including a central hole defined centrally in a top thereof, a rod located in the central hole, multiple first grooves formed axially along an outer surface of an upper section of the drive shaft, a driving portion formed to a lower end of the drive shaft;

a bolt extending through bore of the top toothed part and connected to the central hole of the drive shaft, the bolt contacting the rod in the central hole, the drive shaft and the top toothed part being freely rotated relative to each other;

a bottom toothed part mounted to the drive shaft and including multiple bottom teeth which are engaged with the top teeth of the top toothed part, each bottom tooth of the bottom toothed part including a rounded corner at a right corner of a top land thereof, multiple second grooves formed axially along an inner surface of the bottom toothed part and located corresponding to the first grooves of the drive shaft, a stop plate connected to a lower end of the second grooves;

multiple rollers rotatably located between the first and second grooves so that the bottom toothed part is movable axially relative to the drive shaft;

a resilient member mounted to the drive shaft, the resilient member biased between the bottom toothed part and the washer, and a pressure collar threadedly connected to the lower end of the body.

2. The torque output device as claimed in claim 1, wherein a top driving portion is formed to the top of the body.

3. The torque output device as claimed in claim 2, wherein the top driving portion is integrally formed with the body.

4. The torque output device as claimed in claim 1, wherein multiple balls are located between the washer and the pressure collar.

5. The torque output device as claimed in claim 1, wherein the body includes a grip formed to an outside thereof.

6. The torque output device as claimed in claim 1, wherein a first seal is located between a top of the top toothed part and the opening of the body, a second seal is located between the pressure collar and the drive shaft, a third seal is located between the pressure collar and the body, the body includes lubricant received therein.

7. The torque output device as claimed in claim 1, wherein each top tooth of the top toothed part includes a rounded corner at a right corner of the top land thereof, each bottom tooth of the bottom toothed part includes a rounded corner at a left corner of the top land thereof.

8. The torque output device as claimed in claim 1, wherein a cushion plate is located at a top of the second grooves of the bottom toothed part.

9. A torque output device comprising:

a body having a U-shaped cross section and an engaging hole being formed in a top thereof so as to be connected with a wrench, a washer connected to a lower end of the body;

a top toothed part fixed to the body and located beneath the engaging hole, the top toothed part including a bore defined centrally therein, multiple top teeth extending from an underside of the top toothed part, the bore located corresponding to the engaging hole, each top tooth of the top toothed part having an angle between two tooth surfaces thereof, the angle being 10 to 90 degrees, each top tooth of the top toothed part including a rounded corner at a left corner of a top land thereof;

a drive shaft including a central hole defined centrally in a top thereof, a rod located in the central hole, multiple first grooves formed axially along an outer surface of an upper section of the drive shaft, a driving portion formed to a lower end of the drive shaft;

a bolt extending through bore of the top toothed part and connected to the central hole of the drive shaft, the bolt contacting the rod in the central hole, the drive shaft and the top toothed part being are freely rotated relative to each other;

a bottom toothed part mounted to the drive shaft and including multiple bottom teeth which are engaged with the top teeth of the top toothed part, each bottom tooth of the bottom toothed part including a rounded corner at a right corner of a top land thereof, multiple second grooves formed axially along an inner surface of the bottom toothed part and located corresponding to the first grooves of the drive shaft, a stop plate connected to a lower end of the second grooves;

multiple rollers rotatably located between the first and second grooves so that the bottom toothed part is movable axially relative to the drive shaft;

a resilient member mounted to the drive shaft, the resilient member biased between the bottom toothed part and the washer, and a pressure collar threadedly connected to the lower end of the body.

10. The torque output device as claimed in claim 9, wherein multiple balls are located between the washer and the pressure collar.

11. The torque output device as claimed in claim 9, wherein a first seal is located between a top of the top toothed part and the engaging hole of the body, a second seal is located between the pressure collar and the drive shaft, a third seal is located between the pressure collar and the body, the body includes lubricant received therein.

12. The torque output device as claimed in claim 9, wherein each top tooth of the top toothed part including a rounded corner at a right corner of the top land thereof, each bottom tooth of the bottom toothed part including a rounded corner at a left corner of the top land thereof.

13. The torque output device as claimed in claim 9, wherein a cushion plate is located at a top of the second grooves of the bottom toothed part.

14. A torque output device comprising:

a body having a U-shaped cross section and an engaging hole being formed centrally in a top thereof, multiple threads formed on an outer surface of a lower end of the body;

a mark ring mounted to an upper portion of the body and being secured by a fastening member;

a top toothed part fixed to the body and located beneath the engaging hole, the top toothed part including a bore defined centrally therein, multiple top teeth extending from an underside of the top toothed part, the bore located corresponding to the engaging hole, each top tooth of the top toothed part having an angle between two tooth surfaces thereof, the angle being 10 to 90 degrees, each top tooth of the top toothed part including a rounded corner at a left corner of a top land thereof;

a drive shaft including a central hole defined centrally in a top thereof, a rod located in the central hole, multiple first grooves formed axially along an outer surface of an upper section of the drive shaft, a driving portion formed to a lower end of the drive shaft, a clip mounted to outside of the driving portion;

a bolt extending through the bore of the top toothed part and connected to the central hole of the drive shaft, the bolt contacting the rod in the central hole, the drive shaft and the top toothed part being freely rotated relative to each other;

a bottom toothed part mounted to the drive shaft and including multiple bottom teeth which are engaged with the top teeth of the top toothed part, each bottom tooth of the bottom toothed part including a rounded corner at a right corner of a top land thereof, multiple second grooves formed axially along an inner surface of the bottom toothed part and located corresponding to the first grooves of the drive shaft, a stop plate connected to a lower end of the second grooves;

multiple rollers rotatably located between the first and second grooves so that the bottom toothed part is movable axially relative to the drive shaft;

a first resilient member mounted to the drive shaft, a top end of the first resilient member contacting the bottom toothed part;

a pressure collar mounted to the drive shaft and contacting, a lower end of the first resilient member;

a torque adjustment member having multiple threads formed in an inner periphery thereof, the torque adjustment member threadedly connected to the body from the lower end of the body, an inner end of a lower end of the torque adjustment member contacting an underside of the pressure collar, the torque adjustment member including a radial hole defined through a wall thereof, when the torque adjustment member is rotated relative to the body, the first resilient member is compressed by the pressure collar, and a securing unit connected to the radial hole of the torque adjustment member so as to secure the torque adjustment member to the body.

15. The torque output device as claimed in claim 14 further comprising a second resilient member and the first resilient member is located within the second resilient member, the second resilient member is biased between the bottom toothed part and the pressure collar.

16. The torque output device as claimed in claim 14, wherein a first seal is located between the top toothed part and the engaging hole of the body, a second seal is located between the pressure collar and the drive shaft, a third seal is located between the pressure collar and the body, the body includes lubricant received therein.

17. The torque output device as claimed in claim 14, wherein the securing unit includes a tube which is welded to the radial hole of the torque adjustment member, a copper sleeve is located in the tube and has multiple threads which are threadedly connected to the threads of the body, a screw is threadedly connected to the tube and contacts the copper sleeve so as to secure the torque adjustment member to the body.

18. The torque output device as claimed in claim 14, wherein a washer is located on the inner end of the lower end of the torque adjustment member, a room is formed between the pressure collar and the washer, the multiple balls are located in the room between the pressure collar and the washer.

19. The torque output device as claimed in claim 14, wherein each top tooth of the top toothed part includes a rounded corner at a right corner of the top land thereof, each bottom tooth of the bottom toothed part includes a rounded corner at a left corner of the top land thereof.

20. The torque output device as claimed in claim 14, wherein a cushion plate is located at a top of the second grooves of the bottom toothed part.

* * * * *